US009455106B2

(12) United States Patent
Matthiesen et al.

(10) Patent No.: US 9,455,106 B2
(45) Date of Patent: Sep. 27, 2016

(54) THREE-FUNCTION REFLOWABLE CIRCUIT PROTECTION DEVICE

(75) Inventors: Martyn A. Matthiesen, Fremont, CA (US); Anthony Vranicar, Santa Clara, CA (US); Wayne Montoya, Redwood City, CA (US)

(73) Assignee: LITTELFUSE, INC., Chicago, IL (US)

( * ) Notice: Subject to any disclaimer, the term of this patent is extended or adjusted under 35 U.S.C. 154(b) by 829 days.

(21) Appl. No.: 13/019,983

(22) Filed: Feb. 2, 2011

(65) Prior Publication Data

US 2012/0194315 A1 Aug. 2, 2012

(51) Int. Cl.
*H01H 37/76* (2006.01)
*H01H 37/04* (2006.01)

(52) U.S. Cl.
CPC ..... *H01H 37/761* (2013.01); *H01H 2037/046* (2013.01); *H01H 2037/762* (2013.01)

(58) Field of Classification Search
CPC ..... H01H 37/002; H01H 37/60; H01H 37/5427; H01H 37/54; H01H 37/14; H01H 37/761; H01H 37/52; H01H 85/055; H01H 85/10; H01H 85/042; H01H 61/02; H01H 1/504; H01H 2037/762; H01H 2037/046; H02H 5/042; H02H 9/026
USPC ..... 337/142, 152, 153, 297, 401, 402, 337/407–409
See application file for complete search history.

(56) References Cited

U.S. PATENT DOCUMENTS 3,210,502 A * 10/1965 Slonneger ..... 337/105
3,638,083 A * 1/1972 Dornfeld et al. ..... 361/321.1
3,725,835 A 4/1973 Hopkins et al.
3,763,454 A * 10/1973 Zandonatti ..... 337/404
3,846,679 A 11/1974 Jost et al.
3,905,004 A 9/1975 Szevernyi et al.
4,514,718 A 4/1985 Birx
4,527,144 A * 7/1985 Arikawa ..... 337/407
(Continued)

FOREIGN PATENT DOCUMENTS

CN 1324493 A 11/2001
CN 1365131 A 8/2002
(Continued)

OTHER PUBLICATIONS

International Search Report for International Application No. PCT/US2012/049820, mailed Nov. 20, 2012.
(Continued)

*Primary Examiner* — Anatoly Vortman

(57) ABSTRACT

A circuit protection device is configured to protect circuit elements under any one of the following three activation conditions: an over current condition, an over temperature condition, and an activation control current received by a heater element. The circuit element includes first and second electrodes, and the heater element. A sliding contact is connected by a sensing element to the first electrode, second electrode, and heater element, thereby bridging and providing a conductive path between each. A spring element is held in tension by, and exerts a force against, the sliding contact. Upon detection of any one of three activation conditions, the sensing element releases the sliding contact and the force exerted by the spring element moves the sliding contact to another location on the substrate at which the sliding contact no longer provides a conductive path between the first electrode, second electrode, and heater element.

20 Claims, 9 Drawing Sheets

(56) References Cited

U.S. PATENT DOCUMENTS

| | | | | |
|---|---|---|---|---|
| 4,544,988 | A * | 10/1985 | Hochstein | 361/211 |
| 4,658,101 | A * | 4/1987 | Akimoto et al. | 200/16 R |
| 4,808,960 | A * | 2/1989 | Nixon | 337/4 |
| 4,864,824 | A * | 9/1989 | Gabriel et al. | 60/527 |
| 5,014,036 | A * | 5/1991 | Komoto | 337/407 |
| 5,184,269 | A * | 2/1993 | Shimada et al. | 361/24 |
| 5,337,036 | A * | 8/1994 | Kuczynski | 337/343 |
| 5,363,083 | A * | 11/1994 | Fischer | 337/407 |
| 5,831,507 | A * | 11/1998 | Kasamatsu et al. | 337/4 |
| 5,867,360 | A * | 2/1999 | Kishishita et al. | 361/292 |
| 5,872,496 | A * | 2/1999 | Asada et al. | 335/78 |
| 5,877,670 | A * | 3/1999 | Sehlhorst et al. | 337/302 |
| 6,023,406 | A * | 2/2000 | Kinoshita et al. | 361/277 |
| 6,091,315 | A * | 7/2000 | Hofsass | 337/13 |
| 6,348,851 | B1 * | 2/2002 | Wyser et al. | 337/411 |
| 6,353,527 | B2 * | 3/2002 | Kinoshita et al. | 361/277 |
| 6,396,381 | B1 * | 5/2002 | Takeda | 337/377 |
| 6,396,382 | B1 | 5/2002 | Ross | |
| 6,828,888 | B2 * | 12/2004 | Iwata et al. | 335/78 |
| 6,897,760 | B2 | 5/2005 | Kawata et al. | |
| 6,917,276 | B1 | 7/2005 | Menard et al. | |
| 7,330,097 | B2 * | 2/2008 | Takeda | 337/102 |
| 7,345,570 | B2 * | 3/2008 | Kawanishi | 337/142 |
| 7,385,474 | B2 * | 6/2008 | Kawanishi | 337/142 |
| 7,462,790 | B2 | 12/2008 | Miki | |
| 7,474,194 | B2 | 1/2009 | Darr et al. | |
| 7,576,630 | B2 | 8/2009 | Darr | |
| 7,737,816 | B1 * | 6/2010 | Yu | 337/142 |
| 7,791,448 | B2 * | 9/2010 | Yu | 337/142 |
| 7,808,361 | B1 * | 10/2010 | Yu | 337/142 |
| 7,864,024 | B2 * | 1/2011 | Schlenker et al. | 337/407 |
| 8,289,122 | B2 | 10/2012 | Matthiesen et al. | |
| 8,519,816 | B2 * | 8/2013 | Takeda | 337/398 |
| 2002/0163408 | A1 * | 11/2002 | Fujii et al. | 335/2 |
| 2003/0151868 | A1 * | 8/2003 | Inae et al. | 361/88 |
| 2005/0280975 | A1 * | 12/2005 | Iwata et al. | 361/160 |
| 2006/0273876 | A1 * | 12/2006 | Pachla et al. | 337/140 |
| 2008/0237022 | A1 * | 10/2008 | Miki | 200/536 |
| 2008/0297301 | A1 * | 12/2008 | Onken et al. | 337/219 |
| 2010/0033295 | A1 | 2/2010 | Kent et al. | |
| 2010/0245022 | A1 * | 9/2010 | Galla et al. | 337/159 |
| 2010/0245027 | A1 * | 9/2010 | Matthiesen et al. | 337/297 |
| 2010/0328020 | A1 * | 12/2010 | Wiryana et al. | 337/232 |
| 2011/0121936 | A1 * | 5/2011 | Dietsch et al. | 337/290 |
| 2011/0211284 | A1 | 9/2011 | Yoneda | |
| 2012/0194315 | A1 | 8/2012 | Matthiesen et al. | |
| 2012/0194958 | A1 | 8/2012 | Matthiesen et al. | |
| 2013/0200984 | A1 | 8/2013 | Matthiesen et al. | |

FOREIGN PATENT DOCUMENTS

| | | | |
|---|---|---|---|
| DE | 10-2009-036578 | B3 | 9/2010 |
| JP | 2001-243863 | A | 9/2001 |
| TW | 201246252 | A | 11/2012 |
| WO | WO-2009/130946 | A1 | 10/2009 |

OTHER PUBLICATIONS

International Search Report for International Application No. PCT/US2012/023677, mailed May 11, 2012.

International Search Report for International Application No. PCT/US2012/023603, mailed May 10, 2012.

* cited by examiner

THREE-FUNCTION REFLOWABLE CIRCUIT PROTECTION DEVICE

BACKGROUND

I. Field

The present invention relates generally to electronic protection circuitry. More, specifically, the present invention relates to an electrically activated three-function surface mount circuit protection device.

II. Background Details

Protection circuits are often times utilized in electronic circuits to isolate failed circuits from other circuits. For example, the protection circuit may be utilized to prevent electrical or thermal fault condition in electrical circuits, such as in lithium-ion battery packs. Protection circuits may also be utilized to guard against more serious problems, such as a fire caused by a power supply circuit failure.

One type of protection circuit is a thermal fuse. A thermal fuse functions similar to that of a typical glass fuse. That is, under normal operating conditions the fuse behaves like a short circuit and during a fault condition the fuse behaves like an open circuit. Thermal fuses transition between these two modes of operation when the temperature of the thermal fuse exceeds a specified temperature. To facilitate these modes, thermal fuses include a conduction element, such as a fusible wire, a set of metal contacts, or set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

In operation, current flows through the fuse element. Once the sensing element reaches the specified temperature, it changes state and the conduction element switches from the conductive to the non-conductive state.

One disadvantage of some existing thermal fuses is that during installation of the thermal fuse, care must be taken to prevent the thermal fuse from reaching the temperature at which the sensing element changes state. As a result, some existing thermal fuses cannot be mounted to a circuit panel via reflow ovens, which operate at temperatures that will cause the sensing element to open prematurely.

Thermal fuses described in U.S. patent application Ser. No. 12/383,595, filed Mar. 24, 2009 and published as US 2010/0245022, and U.S. application Ser. No. 12/383,560, filed Mar. 24, 2009 and published as US 2010/0245027—the entirety of each of which are incorporated herein by reference—address the disadvantages described above. Further disadvantages include size and versatility. Circuit protection devices are often too tall to meet the height constraints for circuit board mounted devices. Circuit protection devices also often do not provide the versatility to allow the circuit protection device to activate under all the conditions necessary to adequately protect the circuit. While progress has been made in providing improved circuit protection devices, there remains a need for improved circuit protection devices.

SUMMARY

A circuit protection device is configured to protect circuit elements under any one of the following three activation conditions: an over current condition, an over temperature condition, and an activation control current received by a heater element. The circuit protection device includes a substrate with first and second electrodes connected to the circuit to be protected. The circuit protection device also includes a heater element positioned between the first and second electrodes. A sliding contact is connected by a sensing element to the first electrode, second electrode, and heater element, thereby bridging and providing a conductive path between each. A spring element is held in tension by, and exerts a force parallel to a length of the substrate against, the sliding contact. The connection provided by the sensing element between the sliding contact and the first electrode, second electrode and heater element resists the force exerted by the spring element. Upon detection of any one of the activation conditions, the sensing element releases the sliding contact and the force exerted by the spring element moves the sliding contact to another location on the substrate at which the sliding contact no longer provides a conductive path between the first electrode, second electrode, and heater element.

DETAILED DESCRIPTION

Figure 1:
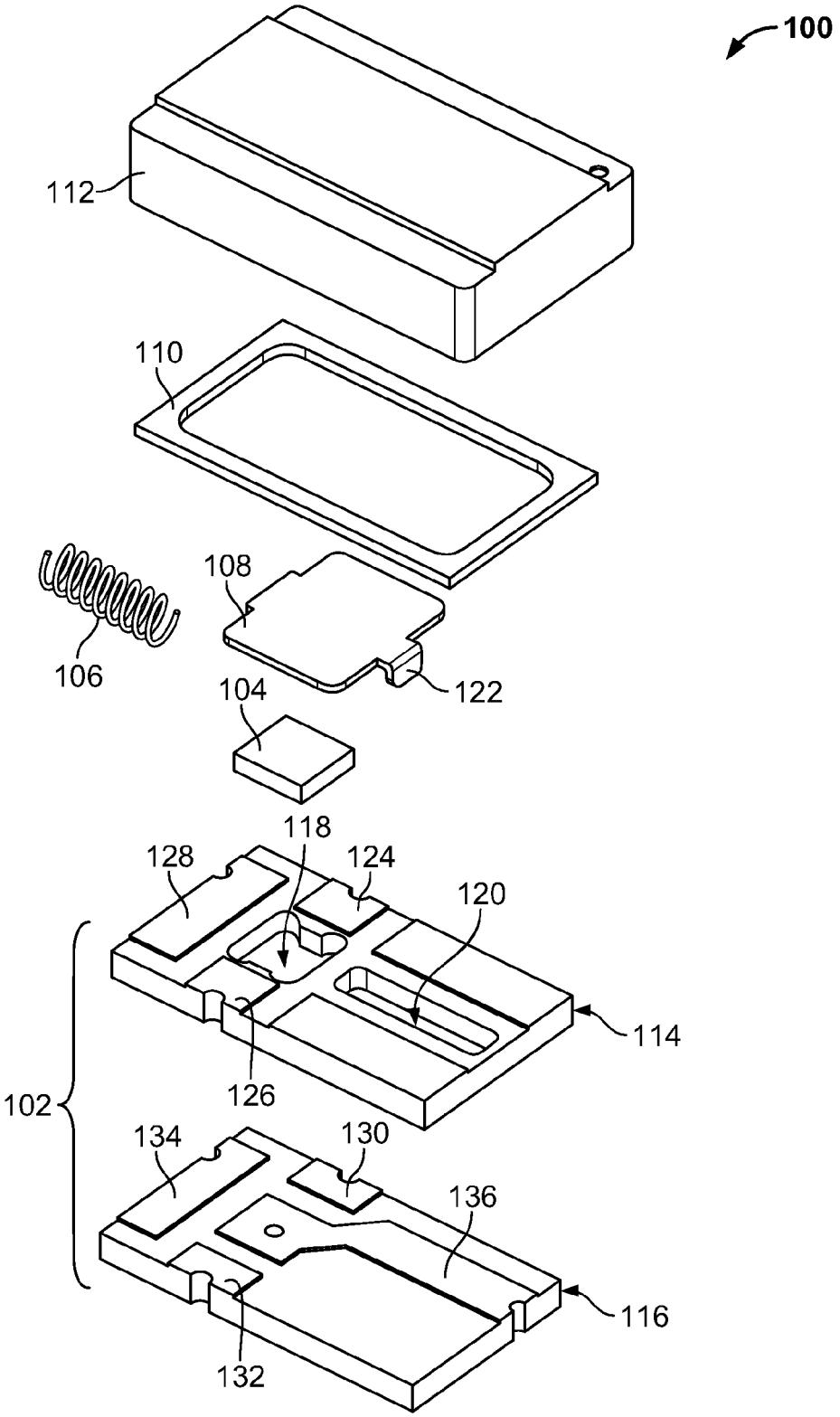
FIG. 1 is an exploded view of an unassembled exemplary three-function reflowable circuit protection device.

FIG. 1 is an exploded view of an unassembled exemplary three-function reflowable circuit protection device 100. The circuit protection device 100 includes a substrate 102, a heater element 104, a spring element 106, a sliding contact 108, and a spacer 110. The circuit protection device 100 may also include a cover 112.

The substrate 102 may include a printed circuit board (PCB). For the sake of explanation, the substrate 102 is described as a multilayer PCB including a top PCB 114 and a bottom PCB 116. It will be understood that the substrate 102 may also be fabricated as a single layer.

The top PCB 114 includes an opening 118 that receives the heater element 104. The height of the top PCB 114 may be set to allow the top of the heater element 104, when placed in the opening 118, to be co-planar with the top surface of the substrate 102, i.e., with the top surface of the top PCB 114. In another embodiment shown in FIG. 7 and described in more detail below, the heater element 104 may be laid up into the substrate 102 during the fabrication process. In this example, the substrate 102 may not include the opening 118.

The top PCB 114 may also include another opening 120 for receiving a cantilever portion 122 of the sliding contact 108. The opening 120 in FIG. 1 extends parallel to the length of the substrate 102, allowing the sliding contact 108 to slide in a direction parallel to the length of the substrate 102. In another embodiment shown in FIGS. 8-9 and described in more detail below, the cantilever 122 may extend away from the substrate 102 towards the cover 112. In this example, substrate 102 may not include the opening 120.

Figure 3A:
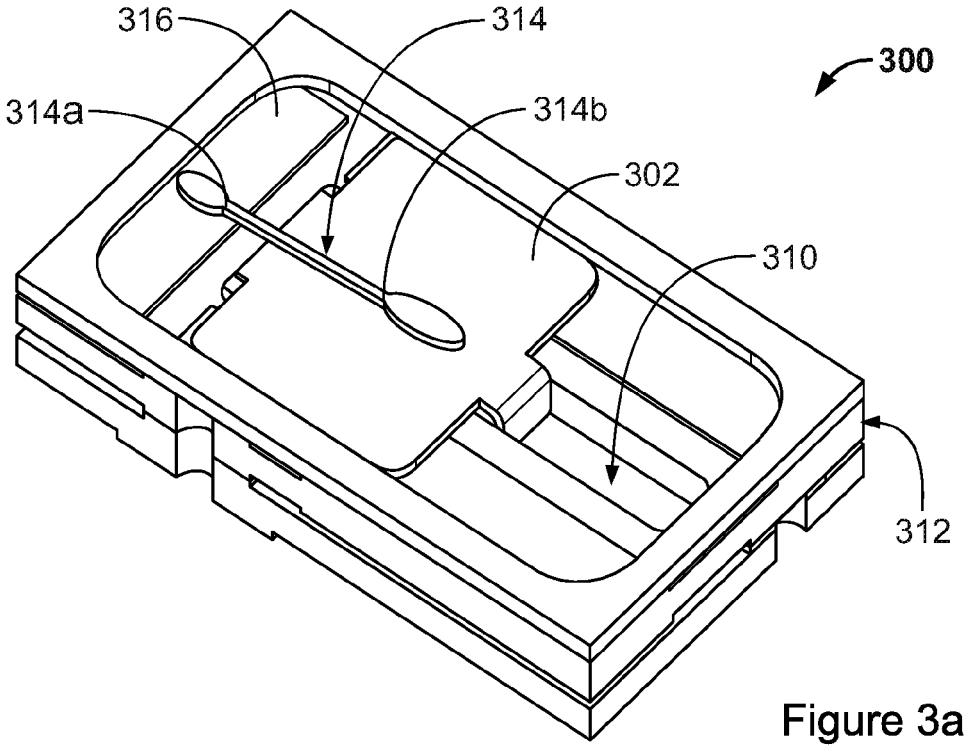
FIG. 3*a* is a circuit protection device with the sliding contact in the closed position.
Figure 3B:
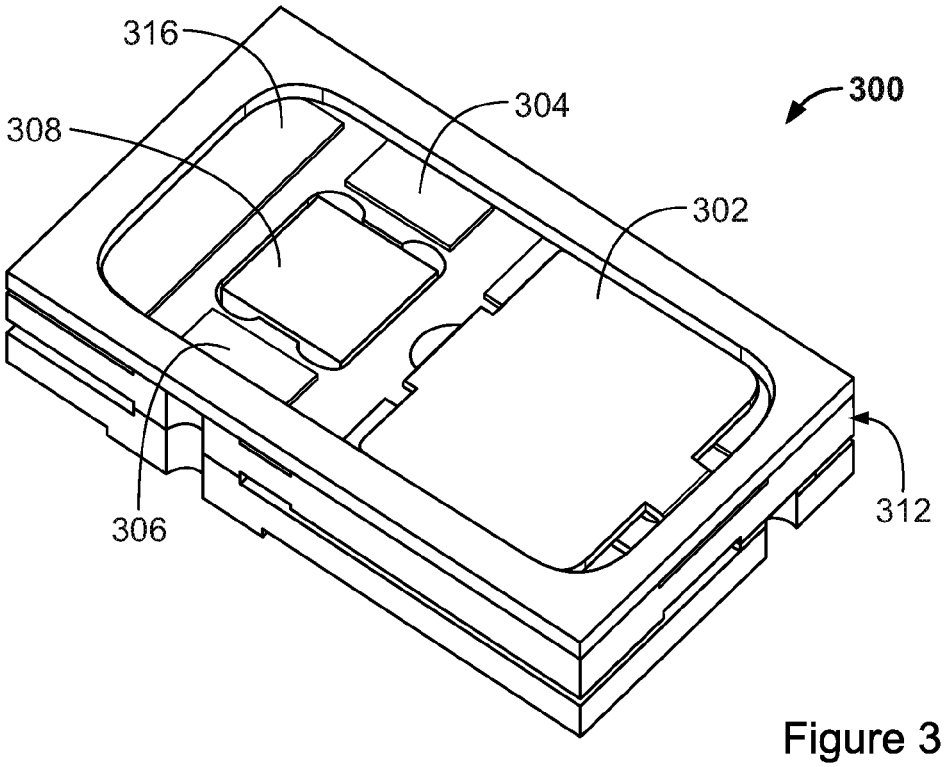
FIG. 3*b* is the circuit protection device of FIG. 3*a* with the sliding contact in the open position.

The top PCB 114 includes pads/electrodes, 124, 126 and 128. The electrodes 124 and 126 may be positioned on opposite sides of the opening 118 along a width of the top PCB 114. The electrode 128 may be positioned on a side of the opening 118 opposing the side the opening 120 is located on opposite sides of the opening 118. As shown in FIGS. 3*a*-3*b*, the sliding contact 108 bridges the electrodes 124 and 126 and the heater element 104 when the sliding contact 108 is in a ready or closed position, thus facilitating an electrical connection between the heater element 104, electrode 124 and electrode 126.

Figure 2A:
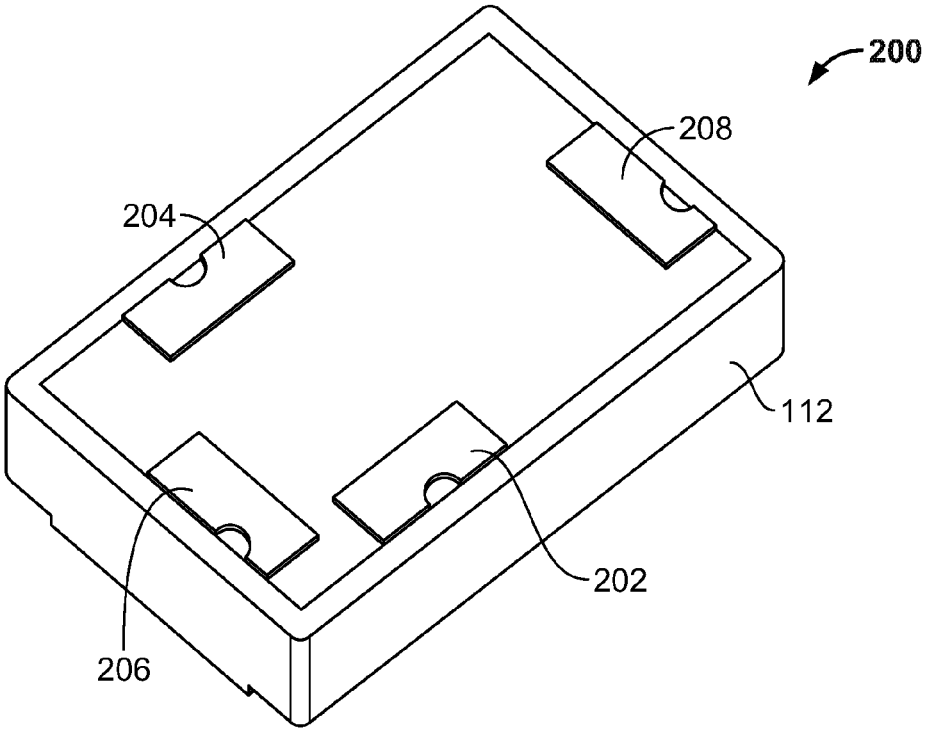
FIG. 2*a* is a bottom view an assembled circuit protection device.

The bottom PCB 116 includes pads 130, 132 and 134 corresponding to the location of the electrodes 124, 126 and 128, respectively, of the top PCB 114. The bottom PCB 116 may also include pad 136 corresponding to the location of the heater element 104. As shown in FIG. 2*a*, the bottom side of the bottom PCB 116 includes terminals corresponding to the pads 130, 132, 134 and 136 for connection to the circuit to be protected.

Figure 7:
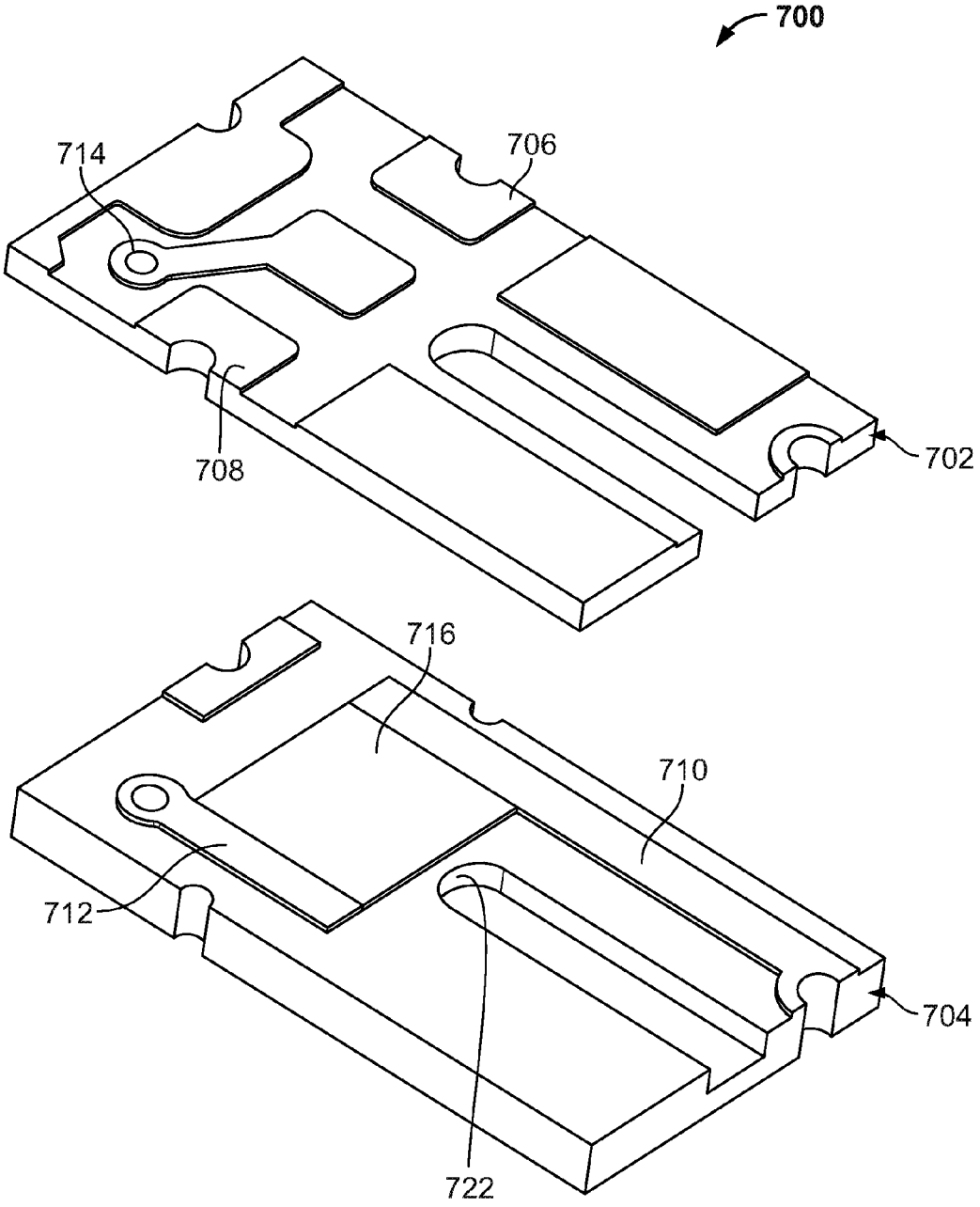
FIG. 7 is another embodiment for the substrate of a three-function reflowable circuit protection device.

As noted, the heater element 104 fits into the opening 118 in the substrate 102. The heater element 104 may also constitute another electrode of the circuit protection device 100. The heater element 104 may be a positive temperature coefficient (PTC) device, such as the PTC device disclosed in U.S. application Ser. No. 12/383,560, filed Mar. 24, 2009, the entirety of which is incorporated herein by reference. Other heater elements, such as a conductive composite heater, that generate heat as a result of current flowing through the device, may be utilized in addition to or instead of the PTC device. In another example, the heater element 104 may be zero temperature coefficient element or constant wattage heater. As shown in FIG. 7, in another embodiment the heater element may also be a thin-film resistor or heating device laid up into the substrate during a PCB process.

The sliding contact 108 may be a conductive and planar element with the cantilever portion 122. The cantilever portion 122 fits into the opening 120. The spring element 106 is located between the cantilever 122 and a side of the opening 120. The sliding contact 108 may be fused to the heater element 104 and electrodes 124, 126 with, for example, a low melt-point sensing element (not shown). When the sensing element changes state, e.g., melts at a threshold temperature, the sliding contact 108 is no longer fused to the electrodes 124, 126 and heater element 104, and the spring element 106 expands and pushes the sliding contact 108 down the channel 120. The sensing element may thus provide mechanical, and electrical, contact between the sliding contact 108 and the electrodes 124, 126 and heater element 104.

The sensing element may be, for example, a low melt-point metal alloy, such as solder. For the sake of explanation, the sensing element is described herein as a solder. It will be understood that other suitable materials may be used as the sensing element such as, for example, a conductive thermoplastic having a softening point or melting point.

With the sliding contact 108 soldered to the heater element 104 and electrodes 124, 126, the spring element 106 between the cantilever 122 and the side of the opening 120 is held in a compressed state. When the solder that holds the sliding contact 108 to the heater element and electrodes 124, 126 melts, the spring element 106 is allowed to expand, pushing against the cantilever 122 and causing it to slide down the opening 120, which in turn pushes the sliding contact 108 off the heater element 104 and electrodes 124, 126. In this manner, the electrical connection between the heater element 104, electrode 124 and electrode 126 is broken. FIGS. 3*a* and 3*b*, described below, show a circuit protection device in a closed and an open position, respectively.

The spring element 106 may be a coil spring made of copper, stainless steel, plastic, rubber, or other materials known or contemplated to be used for coil springs. The spring element 106 may be of other compressible materials and/or structures known to those of skill in the art. For the sake of explanation, the spring element 106 is described as being held under tension in a compressed state by the sliding contact 108. It will be understood that a spring element may also be configured to be held under tension in an expanded or stretched state, such as if the spring element comprises an elastic material. In this example, when an activation condition is detected and the solder melts, the spring element may pull the sliding contact off a heater element and electrodes of the substrate.

The circuit protection device 100 is configured to open under at least three conditions. The solder can be melted by an over current condition, i.e., by a current through electrodes 124 and 126. When a current passing through the electrodes 124 and 126 reaches a threshold current, i.e., a current that exceeds a designed hold current, Joule heating will cause the solder to melt, or otherwise lose resilience, and the sliding contact 108 to move to the open position by being pushed open by the spring element 106.

The solder can be melted by an over temperature condition where the temperature of the device 100 exceeds, such as by an overheating FET or high environmental temperatures, the melting point of the solder holding the sliding contact 108 to the electrodes 124, 126 and the heater element 104. For example, the ambient temperature surrounding the circuit protection device 100 may reach a threshold temperature, such as 140° C. or higher, that causes the solder to melt or otherwise lose resilience. After the solder melts, the sliding contact 108 is pushed down the channel 120 and into an open position, thus preventing electrical current from flowing between the electrodes 124, 126 and the heater element 106.

The solder can also be melted by a controlled activation condition where the heater element 104 is activated by a control current supplied by the circuit into which the circuit protection device 100 is installed. For example, the circuit protection device may pass a current to the heater element 104 upon detection of an overvoltage in the circuit, causing the device to act as a controlled activation fuse. As the current flowing through the heater element 104 increases, the temperature of the heater element 104 may increase. The increase in temperature may cause solder to melt, or otherwise lose resilience, more quickly, resulting in the sliding contact 108 moving to an open position.

The circuit protection device 100 also includes a restraining element (not shown) that holds the sliding contact 108 in the closed position during reflow. During a reflow process, the solder holding the sliding contact 108 to the heater element 104 and electrodes 124, 126 can melt, which would result in the sliding contact 108 moving to the open position due to the force of the compressed spring 106. For example, the melt point of the solder may be approximately 140° C., while the temperature during reflow may reach more than 200° C., for example 260° C. Thus, during reflow the solder would melt, causing the spring element 106 to prematurely move the sliding contact 108 to the open position.

To prevent the force applied by the spring element 106 from opening the circuit protection device 100 during installation, the restraining element may be utilized to maintain the holding sliding contact 108 in place and resist the expansion force of the spring 106. After the reflowable thermal fuse is installed on a circuit or panel and passed through a reflow oven, the restraining element may be blown by applying an arming current through the restraining element. This in turn arms the reflowable thermal fuse.

A spacer 110 may be placed on the substrate 102. The spacer 100 is an insulating material, such as a ceramic, polymeric, or glass, or a combination of thereof. For example, the spacer 100 may be made of a fiber or glass-reinforced epoxy. The spacer 100 includes an opening that forms a channel that allows the sliding contact 108 to slide under the conditions discussed above. The spacer 110 may have a height slightly greater than a height of the sliding contact 108 such that when the cover 112 is placed on the circuit protection device 100, the underside of the cover abuts with the spacer 110, allowing the sliding contact 108 to slide freely and avoiding any friction between the sliding contact 108 and the cover 112.

Described below is an exemplary process for assembling the circuit protection device 100. The substrate 102 may be fabricated by a PCB panel process, where circuit board pads form primary terminals, and plated vias make the connection from these terminals to surface mount pads. Slots may be cut using known drill and router processes. As an alternative, discrete, injection-molded parts with terminals that are insert-molded, or installed in a post-molding operation, may be used.

After the substrate 102 is fabricated and patterned, the heater element 104 may be installed in the substrate 102, such as by soldering the bottom of the heater element 104 to the substrate 102. The spring element 106 is inserted into the channel 120. The sliding contact 108 is inserted and slid to place the spring element 106 in a compressed state between the cantilever 122 and a side of the channel 120. The sliding contact 108 is soldered to the heater element 104 and the electrodes 124, 126.

The restraining element is attached to the sliding contact 108 on one end, and to the electrode 128 on the other end. Alternatively, one end of the restraining element may be attached to the sliding contact 108 before the sliding contact is soldered to the heater element 104 and electrodes 124, 126. In this example, the other end of the restraining element is attached to the electrode 128 after soldering of the sliding contact 108. The restraining element may be attached by resistance welding, laser welding, or by other known welding techniques.

The spacer 110 may then be placed on top of the substrate 102, the opening within the spacer having a width sufficient for the sliding contact 108 to fit within. The cover 112 may then be installed to keep the various parts in place.

Figure 2B:
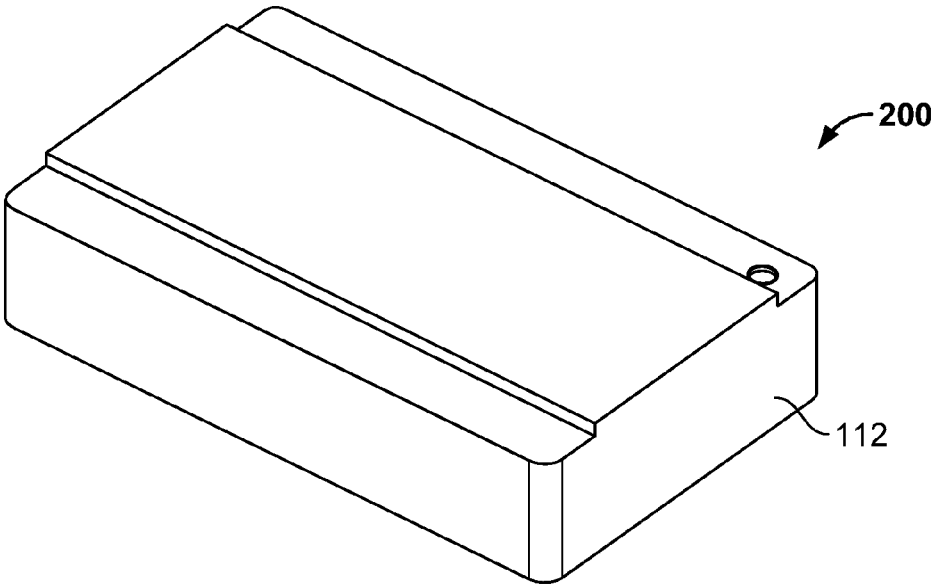
FIG. 2*b* is a top view the assembled circuit protection device shown in FIG. 2*a*.

FIGS. 2*a*-2*b* show bottom and top views, respectively, of an assembled circuit protection device 200. The bottom of the circuit protection device may include terminals 202, 204, 206, 208 that facilitate electrical connection of the electrodes 124, 126, 128 and the heater element 106, respectively, to external circuit board elements. In this manner the terminals 202, 204, 206, 208 may be utilized to mount the circuit protection device 200 to a surface of a circuit panel (not shown) and bring the heater element 106, electrodes 124, 126, 128 into electrical communication with circuitry outside of the device 200.

In order to achieve a low profile, the height of the circuit protection device 200 may be 1.5 mm or less. The width of the circuit protection device 200 may be 3.8 mm or less. The length of the circuit protection device 200 may be 6.0 mm or less. In one embodiment, the circuit protection device may be 6.0 mm×3.8 mm×1.5 mm. Due to the expansion force of the spring element being parallel to the plane of the substrate surface, which results in the sliding contact also sliding parallel to the plane of the substrate, a substantially thin circuit protection device 200 is achieved.

FIGS. 3*a*-3*b* show a circuit protection device 300 with the sliding contact 302 in the closed and open positions, respectively. In the closed position the sliding contact 302 bridges and provides an electrical connection between the electrodes 304, 306 and the heater element 308. In the open position, when the solder holding the sliding contact 302 to the electrodes 304, 306 and heater element 308 melts, the force of an expanding spring element pushes the sliding contact 302 down the channel 310 in the substrate 312, severing the electrical connection between the electrodes 304, 306 and heater element 308. As discussed above, the circuit protection device 300 is a three-function reflowable thermal fuse that is configured to open under three conditions: over current, over temperature, and controlled activation.

FIG. 3*a* also shows the restraining element 314 discussed above. The restraining element 314 may be a welded, fusible restraining wire that holds the sliding contact 302 in place during reflow. In particular, the restraining element 314 is adapted to secure the sliding contact 302 in a state that prevents it from sliding down the channel 310 during reflow. For example, the restraining element 314 may enable keeping the spring element in a compressed state even with the solder or other material holding the sliding contact 302 to the electrodes 304, 306 and heater element 308 melts, thereby preventing the spring element from expanding and pushing the sliding contact 302 down the channel 310.

The restraining element 314 may made of a material capable of conducting electricity. For example, the restraining element 314 may be made of copper, stainless steel, or an alloy. The diameter of the restraining element 314 may be sized so as to enable blowing the restraining element 314 with an arming current. The restraining element 314 is blown, such as by running a current through the restraining element 314, after the device 300 is installed. In other words, sourcing a sufficiently high current, or arming current, through the restraining element 314 may cause the restraining element 314 to open. In one embodiment, the arming current may be about 2 Amperes. However, it will be understood that the restraining element 314 may be increased or decrease in diameter, and/or another dimension, allowing for higher or lower arming currents.

To facilitate application of an arming current, a first end 314*a* and second end 314*b* of the restraining element 314 may be in electrical communication with various pads disposed about the housing. The first end 314*a* may be connected to the electrode 316, which corresponds to the electrode 128 in the embodiment of FIGS. 1-2. Referring to the embodiment of FIGS. 1-2, the electrode 316 (or 128) is in electrical communication with the terminal 206. The second end 314*b* may be connected to the sliding contact 302. The arming current may be supplied to the electrode 316 through terminal 206.

Described below is an exemplary process for installing the three-function reflowable circuit protection devices described herein. The circuit protection device is placed on a panel. Solder paste may be printed on a circuit board before the circuit protection device is positioned. The panel, with the circuit protection device, is then placed into a reflow oven which causes the solder on the pads to melt. After reflowing, the panel is allowed to cool.

An arming current is run through pins of the circuit protection device so as to blow the restraining element. Referring to FIG. 2, sufficient current, for example, 2 Amperes, may be applied to the terminal 206, which is electrically connected to the restraining element, so as to blow the restraining element and allow the spring element to push the sliding contact in the open position under one of the three conditions described herein. Blowing the restraining element places the circuit protection device in an armed state.

Figure 4:
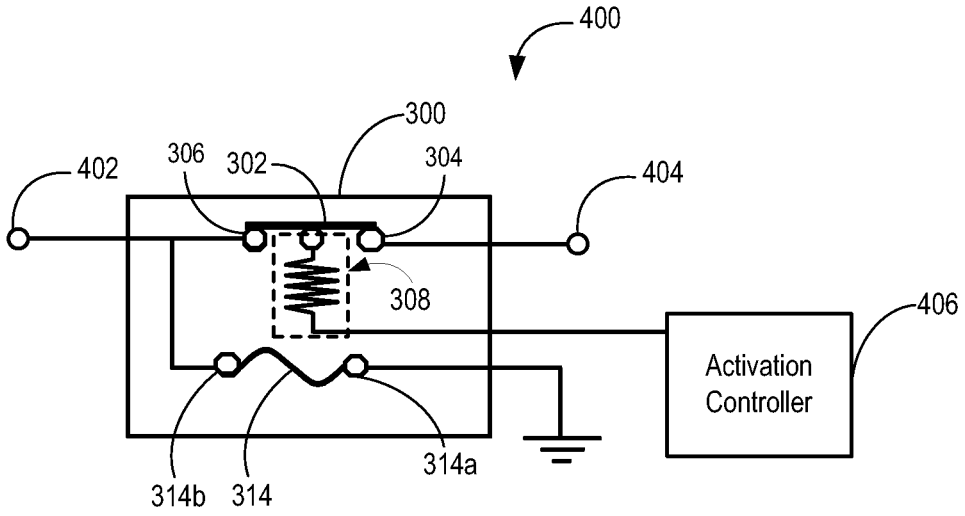
FIG. 4 is a schematic representation of an exemplary battery pack circuit to be protected by a circuit protection device before the restraining element is blown.
Figure 5:
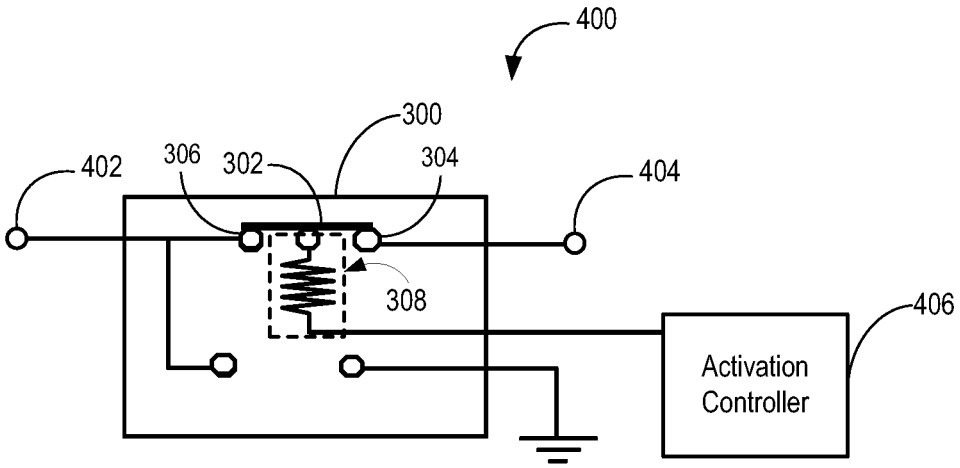
FIG. 5 is a schematic representation of the circuit of FIG. 4 with the restraining element blown and the sliding contact in the closed position.
Figure 6:
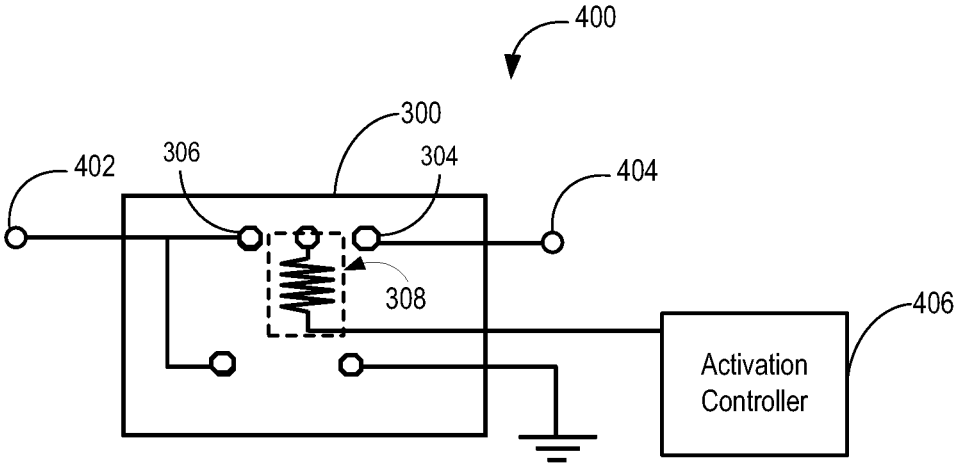
FIG. 6 is a schematic representation of the circuit of FIG. 5 with the sliding contact in the open position.

FIGS. 4-6 are a schematic representation of an exemplary battery pack circuit 400 to be protected by a circuit protection device. In the example shown in FIGS. 4-6, the circuit 400 utilizes the circuit protection device 300 of FIG. 3. For the sake of explanation, the circuit protection device 300 can be positioned in series with two terminals 402, 404 connected to circuit components to be protected, such as one or more FETs. It will be understood that the circuit protection device 300 may be used in other circuit configurations. The heater element 308 is electrically connected to an activation controller 406.

FIG. 4 shows the circuit protection device 300 before the restraining element 314 is blown. FIG. 5 shows the circuit protection 300 after the restraining element 314 is blown. Further, in FIGS. 4-5 the sliding contact 302 is in the closed position, thus bridging and providing an electrical connected between electrode 304, electrode 306, and electrode 308 (i.e., the heater element). FIG. 6 shows the circuit protection device 300 in the open position in which the electrical connected between the electrodes 304, 306, 308 is severed, such as after a fault condition (over current or over temperature) is detected, or after an activation signal by the activation controller 406.

FIG. 7 shows another embodiment for the substrate 700 of a three-function circuit protection device. In this embodiment utilizes an embedded resistor concept used in PCB construction. The substrate 700 includes a top PCB layer 702 and a bottom PCB layer 704. The top PCB layer 702 includes pads 706, 708 for electrical connection to patterned electrodes 710, 712, respectively, in the bottom PCB layer. The top PCB layer 702 also includes a via connection 714 to the heater element 716 that is laid up into the substrate 700 during a PCB process. In this example, the heater element 716 is a thin-film resistor or other heating device. With the film in this embodiment, the resistance path is transverse to the plane of the film.

Figure 8:
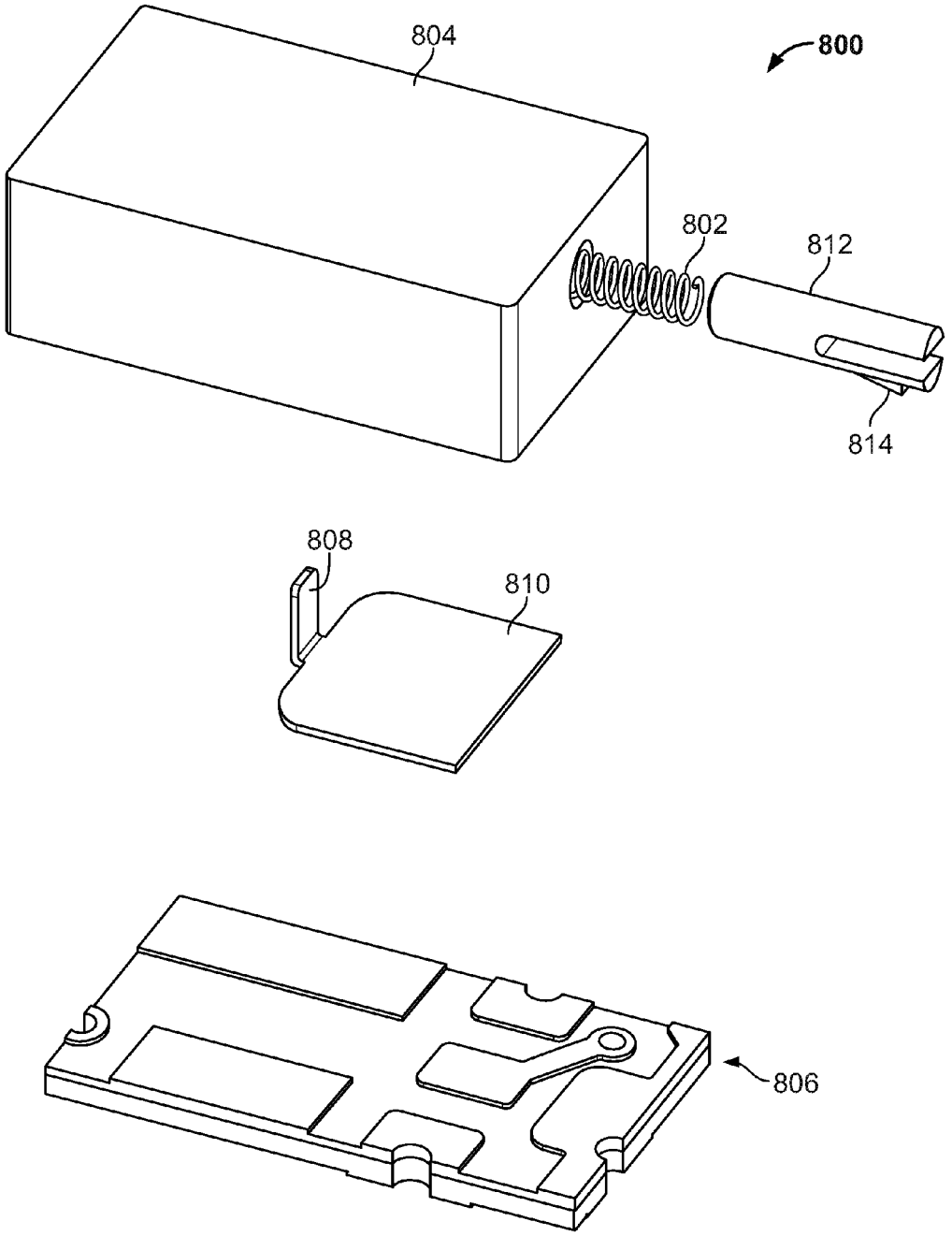
FIG. 8 is top view of another embodiment of a three-function reflowable circuit protection device.
Figure 9:
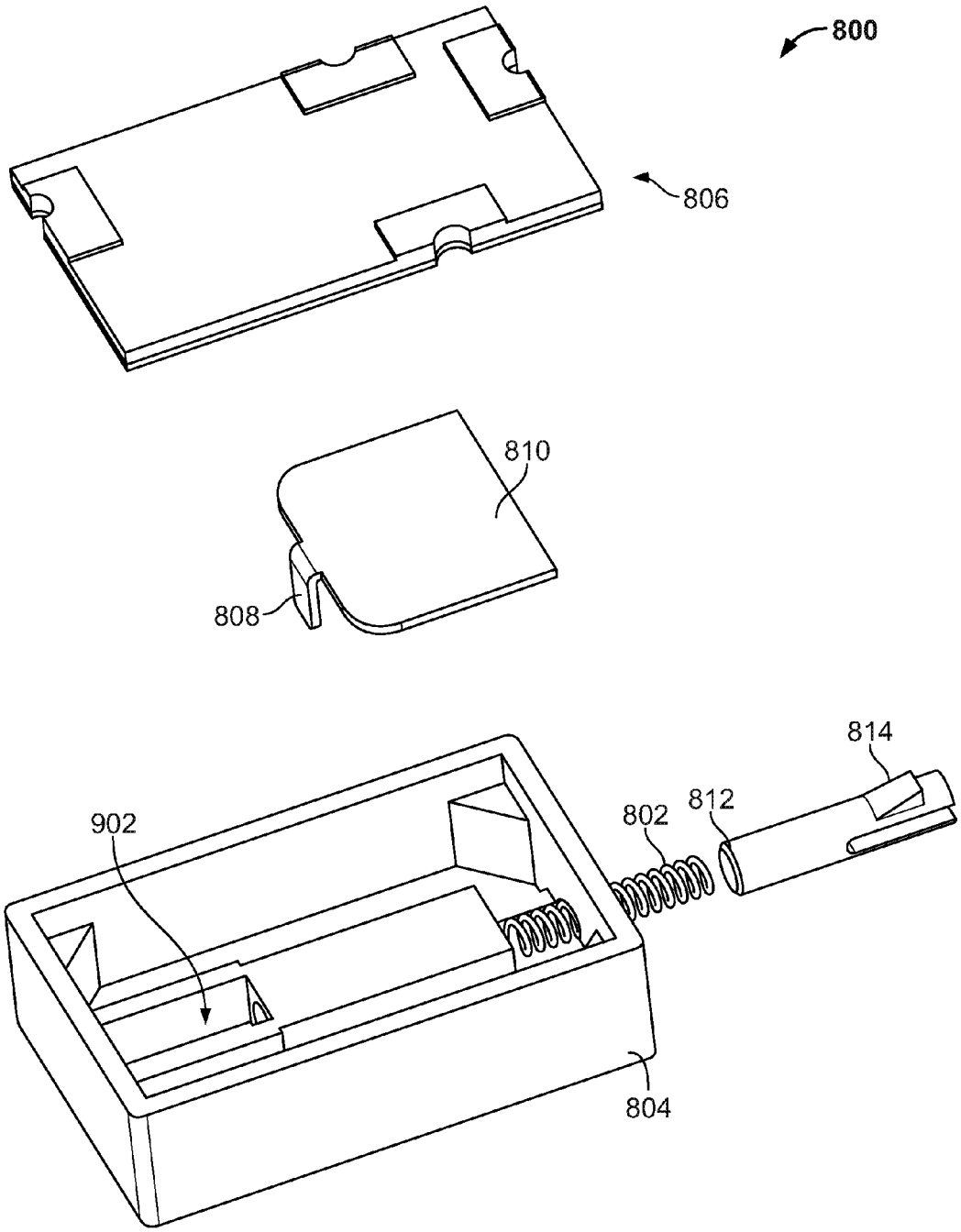
FIG. 9 is bottom view of the three-function reflowable circuit protection device shown in FIG. 8.

FIGS. 8-9 show top and bottom views, respectively, of another embodiment of a three-function reflowable circuit protection device 800. In the circuit protection device 800, the spring element 802 is located in the cover 804 instead of within the substrate 806. The cantilever portion 808 of the sliding contact 810 extends up into the cover 804 instead of down into an opening in the substrate 806. The substrate 806 in FIGS. 8-9 need not be patterned to include an opening that receives the cantilever portion 808 of the sliding contact 810.

The underside of the cover 804 (shown in FIG. 9) includes a depression, or channel 902, into which the cantilever portion 808 may be inserted, and through which the cantilever portion 808 may slide when the solder holding the sliding contact 810 to the electrodes of the substrate 806 melts.

The spring element 802 may be installed into the cover 804 through a side of the cover 804. A cap 812 may then be inserted into the side of the cover 804 to hold one end of the spring element 802 in place such that when the spring element 802 expands under of the activation conditions described herein, the resulting force will push the cantilever portion 808 down the channel 902. The cap 812 includes a protrusion 814 that is tapered on one end and normal to the length of the cap 812 on the other end. In this manner, the cap 812 may be inserted into a hole on the side of the cover 804 with a snap-fit connection. It will be understood that other methods may be used to insert the spring element 802 into the cover 804.

While the three-function reflowable circuit protection device has been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that the three-function reflowable circuit protection device is not to be limited to the particular embodiments disclosed, but to any embodiments that fall within the scope of the claims.

We claim:

1. A three-function reflowable circuit protection device comprising:

a substrate comprising a first electrode, a second electrode, and a heater element, the heater element receiving an activation control current;

a sliding contact positioned on the substrate at a first location and having a cantilevered portion extending into an opening in the substrate for restricting movement of the sliding contact to a linear path, wherein at the first location the sliding contact is connected to, and provides a conductive path between, the first electrode, second electrode, and the heater element via a sensing element;

a spring element biasing the sliding contact along the linear path to a second location upon loss of resilience of the sensing element, wherein at the second location the sliding contact does not provide a conductive path between any of the first electrode, second electrode, and the heater element, and a restraining element securing the sliding contact at the first location during a reflow process, wherein the sensing element loses resilience upon detection of any one of the following activation conditions:

an over current condition;

an over temperature condition; and the activation control current received by the heater element, and wherein application of an arming current through the restraining element causes the restraining element to break and place the circuit protection device in an armed state.

2. The circuit protection device of claim 1, wherein the sensing element comprises a material that melts at a threshold temperature.

3. The circuit protection device of claim 1, wherein the heater element is one of a thin-film resistor and a positive temperature coefficient device.

4. The circuit protection device of claim 1, wherein the spring element exerts a force on the cantilever portion.

5. The circuit protection device of claim 4, wherein when the sensing element loses resilience, the spring element moves the sliding contact to the second location by pushing the cantilever portion.

6. The circuit protection device of claim 4, wherein when the sensing element loses resilience, the spring element moves the sliding contact to the second location by pulling the cantilever portion.

7. The circuit protection device of claim 1, wherein the over current condition at which the spring element moves the sliding contact to the second location is detected when a current passing between the first and second electrodes exceeds a threshold current and causes the sensing element to melt.

8. The circuit protection device of claim 1, wherein the over temperature condition at which the spring element moves the sliding contact to the second location is detected when an ambient temperature surrounding the circuit protection device exceeds a threshold temperature.

9. The circuit protection device of claim 1, wherein the heater element heats up to a melting point of the sensing element upon receipt of the activation control current.

10. The circuit protection device of claim 1, wherein the substrate comprises mounting pads allowing surface mounting of the circuit protection device to a panel.

11. A reflowable circuit protection device comprising:

a substrate comprising a first electrode, a second electrode, and a heater element between the first and second electrodes;

a sliding contact positioned on the substrate location and having a cantilevered portion extending into an opening in the substrate for restricting movement of the sliding contact to a linear path, wherein:

at a first location on the substrate the sliding contact provides a conductive path between the first electrode, second electrode, and the heater element, at a second location on the substrate the sliding contact does not provide a conductive path between any of the first electrode, second electrode, and the heater element;

a spring element biasing the sliding contact to the second location along the linear path upon detection of any one of the following activation conditions:

an over current condition;

an over temperature condition; and the activation control current received by the heater element, and a restraining element securing the sliding contact at the first location during a reflow process, wherein application of an arming current through the restraining element causes the restraining element to break and place the circuit protection device in an armed state.

12. The circuit protection device of claim 11, further comprising a housing that encases the substrate, sliding contact, and spring element.

13. The circuit protection device of claim 12, wherein a height of the housing that encases the substrate, sliding contact, and spring element circuit is less than or equal to approximately 1.5 mm.

14. The circuit protection device of claim 12, wherein a length of the housing that encases the substrate, sliding contact, and spring element is less than or equal to approximately 6.0 mm.

15. The circuit protection device of claim 12, wherein a width of the housing that encases the substrate, sliding contact, and spring element is less than or equal to approximately 3.8 mm.

16. The circuit protection device of claim 11, wherein the heater element comprises one of a thin-film resistor and a positive temperature coefficient device.

17. The circuit protection device of claim 11, wherein the substrate comprises mounting pads allowing surface mounting of the circuit protection device to a panel.

18. A reflowable circuit protection device comprising:

a substrate comprising a first electrode, a second electrode, and a heater element, the heater element receiving an activation control current;

a sliding contact positioned on the substrate location and having a cantilevered portion extending into an opening in the substrate for restricting movement of the sliding contact to a linear path, wherein:

at a first location on the substrate the sliding contact provides a conductive path between the first electrode, second electrode, and heater element, and at a second location on the substrate the sliding contact does not provide a conductive path between any of the first electrode, second electrode, and heater element; and a spring element exerting on the sliding contact a force directed along the linear path, wherein at the first location the sliding contact resists the force exerted by the spring element until detection of any one of the following activation conditions:

an over current condition;

an over temperature condition; and the activation control current received by the heater element, and wherein upon detection of any one of the activation conditions, the force exerted by the spring element moves the sliding contact to the second location, and a restraining element securing the sliding contact at the first location during a reflow process, wherein application of an arming current through the restraining element causes the restraining element to break and place the circuit protection device in an armed state.

19. The circuit protection device of claim 18, wherein the over current condition at which the spring element moves the sliding contact to the second location is detected when a current passing between the first and second electrodes exceeds a threshold current and causes the sensing element to melt.

20. The circuit protection device of claim 18, wherein the over temperature condition at which the spring element moves the sliding contact to the second location is detected when an ambient temperature surrounding the circuit protection device exceeds a threshold temperature.

* * * * *